US005642580A

United States Patent [19]

Hess et al.

[11] Patent Number: 5,642,580

[45] Date of Patent: Jul. 1, 1997

[54] FLAME SIMULATING ASSEMBLEY

[75] Inventors: Kristoffer Hess, Cambridge; David Miller MacPherson, Paris; Ignazio Gallo, Cambridge, all of Canada

[73] Assignee: Dimplex North America Limited, Cambridge, Canada

[21] Appl. No.: 649,510

[22] Filed: May 17, 1996

[51] Int. Cl.[6] ..... G09F 19/00

[52] U.S. Cl. ..... 40/428

[58] Field of Search ..... 472/65; 362/253, 362/806; 40/428; 392/348

[56] References Cited

U.S. PATENT DOCUMENTS

| | | | |
|---|---|---|---|
| 1,992,540 | 2/1935 | Newton | 40/428 |
| 3,699,697 | 10/1972 | Paintori | 40/428 |
| 4,965,707 | 10/1990 | Butterfield . | |
| 5,195,820 | 3/1993 | Rehberg . | |

FOREIGN PATENT DOCUMENTS

| | | |
|---|---|---|
| 1024047 | 3/1965 | United Kingdom . |
| 1088577 | 10/1967 | United Kingdom . |
| 1164143 | 9/1969 | United Kingdom . |
| 2 151 772 | 7/1985 | United Kingdom . |

*Primary Examiner*—Carroll B. Dority
*Attorney, Agent, or Firm*—Bereskin & Parr

[57] ABSTRACT

An electric fireplace is provided having an improved flame simulating apparatus. The flame simulating apparatus includes a light source, a flame effect element for transmitting light from the light source to produce a flame effect, and a flicker element having colored reflective strips for reflecting light for subsequent transmission by the flame effect element. A screen having a partially reflecting surface and a diffusing surface is positioned with the flame effect element extending proximate to the diffusing surface. A fuel bed is positioned immediately adjacent to the partially reflecting surface of the screen to produce an image of the fuel bed on the screen with the image of moving flames appearing to emanate between the fuel bed and its reflected image.

37 Claims, 9 Drawing Sheets

FLAME SIMULATING ASSEMBLEY

FIELD OF THE INVENTION

The present invention relates to flame simulating assemblies for electric fireplaces and the like.

BACKGROUND OF THE INVENTION

Electric fireplaces are popular because they provide the visual qualities of real fireplaces without the costs and complications associated with venting of the combustion gases. An assembly for producing a realistic simulated flame for electric fireplaces is disclosed in U.S. Pat. No. 4,965,707 (Butterfield). The Butterfield assembly uses a system of billowing ribbons and a diffusion screen for simulating flames. The simulated flames are surprisingly realistic, although the effect resembles a flame from a coal fuel source (which is popular in Europe), rather than a log fuel source (which is more popular in North America). The flames for burning logs tend to be more active and extend higher above the fuel source. Also, the log flame tends to be less red (and more yellow) in color than the coal flame.

There is a need for an assembly for producing a simulated flame that more realistically resembles the flame from a burning log. Also, there is a need to improve the light intensity of the simulated flame to more realistically resemble the intensity of real flames.

SUMMARY OF THE INVENTION

The present invention is directed to an improved flame simulating assembly that produces a realistic appearing flame.

In one aspect, the invention provides a flame simulating assembly comprising:

a light source;

a flame effect element having means for transmitting light from said light source to produce a moving flame effect;

at least one flicker element having at least one reflective surface, said flicker element being positioned intermediate of said light source and said flame effect element to reflect light from said light source for subsequent transmission by said flame effect element;

a screen having a partially reflecting surface and a diffusing surface, said flame effect element extending proximate to said diffusing surface wherein said transmitted light produces an image on the screen which resembles moving flames; and a simulated fuel bed positioned adjacent to said partially reflecting surface wherein an image of the fuel bed is displayed on the screen and wherein the image of moving flames appears to emanate between the simulated fuel bed and its image in the screen.

In a second aspect, the invention provides a flame simulating assembly comprising:

a light source;

a flame effect element formed of a single sheet of a substantially opaque material having means for transmitting light from said light source to produce a flame effect, said flame effect element being adapted to move in response to an airflow;

an airflow generator;

a screen having a partially reflecting surface and a diffusing surface, said flame effect element extending proximate to said diffusing surface wherein said transmitted light produces an image on the screen which resembles moving flames; and a simulated fuel bed positioned adjacent to said partially reflecting surface wherein an image of the fuel bed is displayed on the screen and wherein the image of moving flames appears to emanate between the simulated fuel bed and its image in the screen.

In a third aspect, the invention provides a flame simulating assembly, comprising:

a light source;

at least one flicker element having at least one reflective surface for reflecting light from said light source;

a rotor for rotating said flicker element about an axis;

a screen having a partially reflecting surface and a diffusing surface, wherein light reflected from said rotating flicker element onto said diffusing surface produces an image which resembles moving gasses from a fire; and a simulated fuel bed positioned adjacent to said partially reflecting surface wherein an image of the fuel bed is displayed on the screen and wherein the image of moving gasses appears to emanate between the simulated fuel bed and its image on the screen.

In further aspects, a pair of flicker elements are provided for increasing the light intensity of the simulated flame and for simulating flickering colors at the upper end of the flame and at the lower end of the flame adjacent the fuel bed.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF THE PREFERRED EMBODIMENT

Figure 1:
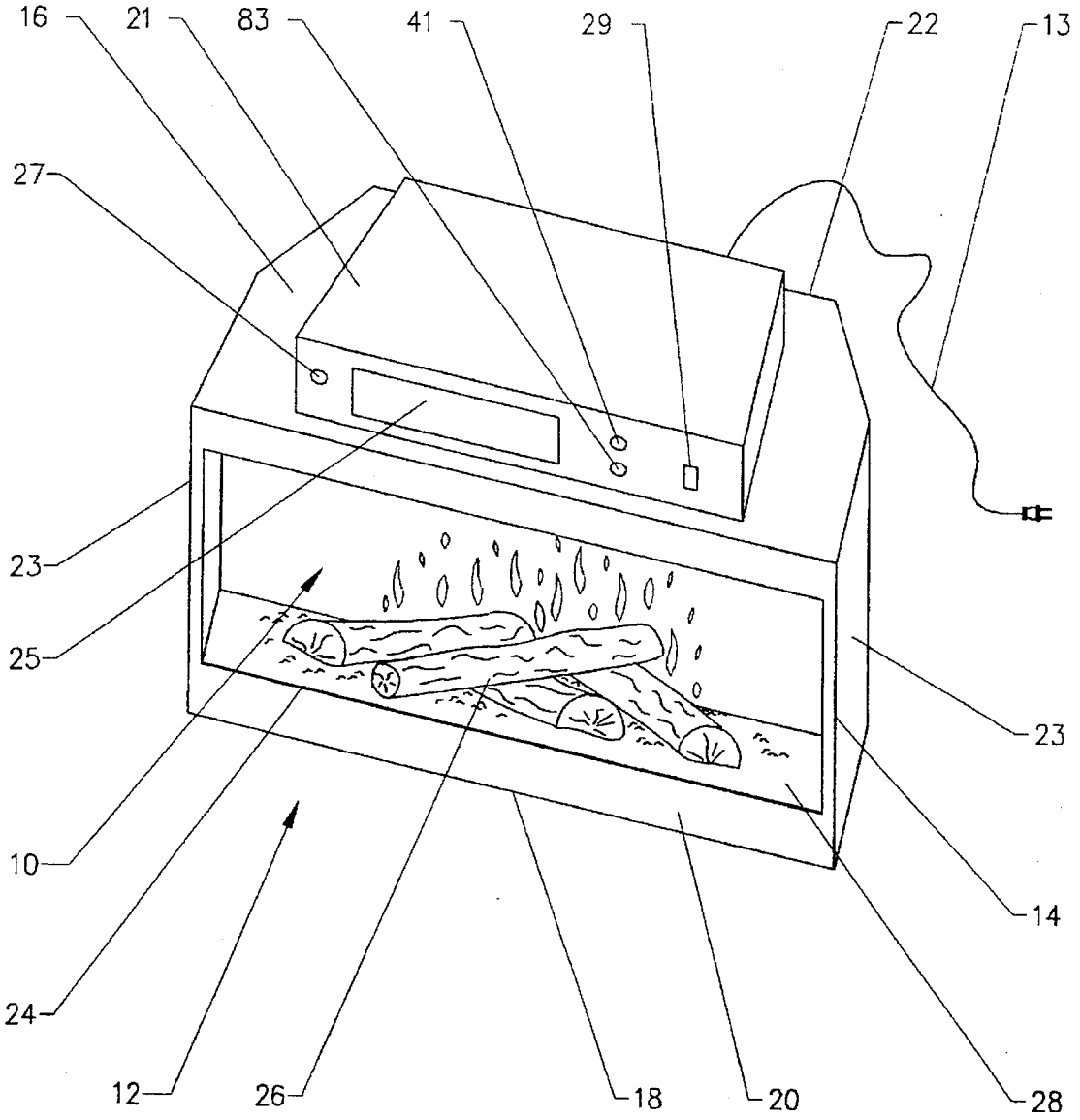
FIG. 1 is a perspective view of an electric fireplace incorporating a flame simulating assembly in accordance with the present invention.

A flame simulating assembly in accordance with the present invention is shown generally at 10 in FIGS. 1–4. The assembly is incorporated within an electric fireplace which is depicted generally at 12 with an electrical connection 13 for connecting to a power source (not shown).

The electric fireplace 12 includes a housing 14 that defines a simulated firebox having top, bottom, front, rear and side walls 16, 18, 20, 22 and 23, respectively. A portion of the front wall is defined by a transparent front panel 24 that is removable to permit access to the contents of the housing 14. A control unit 21 is located above the top wall of the housing. The control unit 21 includes a heater unit 25, a thermostat 27 for controlling the heat output and a main power switch 29 for actuating the flame effect.

A simulated fuel bed 26 (shown schematically in FIG. 2) is supported on a platform 28 located at a lower front portion of the housing 14. The fuel bed 26 comprises a plastic shell that is vacuum formed and colored to resemble logs and embers for a log burning fire.

Portions of the shell are translucent to permit light from a light source 30 located beneath the fuel bed 26 to shine through. For instance, the shell may be formed from an orange translucent plastic. The top side of the plastic shell may be painted in places to resemble the surface of logs. The underside of the plastic shell may be painted black (or some other opaque color) and then sanded in portions where it is desired for light to pass. For instance, the protruding points on the underside of the shell (corresponding to indents in the top side) may be sanded to allow light passage. These points would thus resemble the embers of a fire. Also, the crotch area between simulated logs may be sanded (or left unpainted) to resemble embers at the intersection of two logs.

The light source 30 comprises three 60 watt light bulbs that are supported in sockets 34 below the fuel bed 26. Alternatively, one or more quartz halogen lights may be utilized. The sockets 34 are supported by vertical arms 36 that are connected with fasteners 38 to the bottom wall of the housing 14. A parabolic reflector 40 is located below the light source 30 at the lower front end of the housing 14 to direct light toward the rear of the housing 14. The intensity of the light can be varied with a dimmer switch 41 that is electrically connected to the light source 30 and located on the control unit 21.

Figure 9:
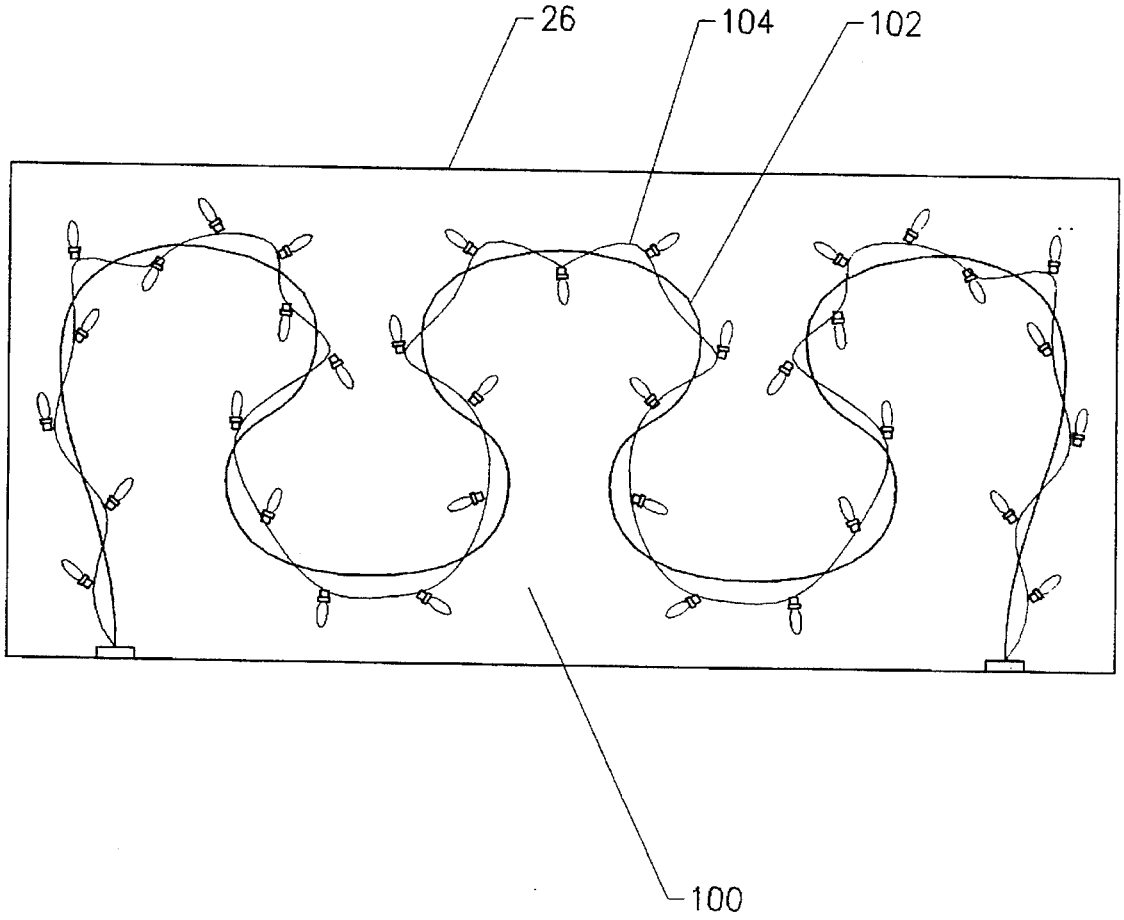
FIG. 9 is a top view of a fuel bed light assembly for the assembly of FIG. 1 in accordance with a further embodiment of the present invention.

In a further embodiment of the invention as shown in FIG. 9, a fuel bed light assembly 100 may be arranged beneath the underside of the fuel bed 26. The fuel bed light assembly 100 includes a support element 102 that supports a string of lights 104 beneath the fuel bed 26. The lights 104 are adapted to flicker at different times to give the impression of increases and decreases in heat (as depicted by differences of light intensity) in the embers of the fuel bed. It has been found that conventional Christmas lights are suitable for this purpose.

Located immediately behind the fuel bed 26 is a vertical screen 42. The screen 42 is transparent and has a partially reflecting surface 44 and a diffusing surface 46. The screen 42 is seated in a groove 48 defined in a lower horizontal support member 50. The lower horizontal support member 50 is fastened to the side walls 23 of the housing 14 with fasteners 52. The screen 42 is supported on its sides with side frame members 54 that are fastened to the side walls 23 with fasteners 56. The screen structure is described in more detail in U.S. Pat. No. 4,965,707 which is incorporated herein by reference.

The screen 42 is positioned immediately behind the fuel bed 26 so that the fuel bed 26 will be reflected in the reflecting surface 44 to give the illusion of depth. As will be explained further below, the image of simulated flames appears to be emanating from between the fuel bed 26 and the reflection of the fuel bed 26 in the screen. Also, simulated flames appear to be emanating from the reflected image of the fuel bed 26. An upper light source 57 is located at the top front portion of the housing for illuminating the top of the simulated fuel bed 26 and enhancing the reflected image in the screen 42.

Referring more closely to the flame simulation assembly 10, the assembly includes a flame effect element 58, a blower 60 and upper and lower flicker elements 62 and 64.

Figure 5:
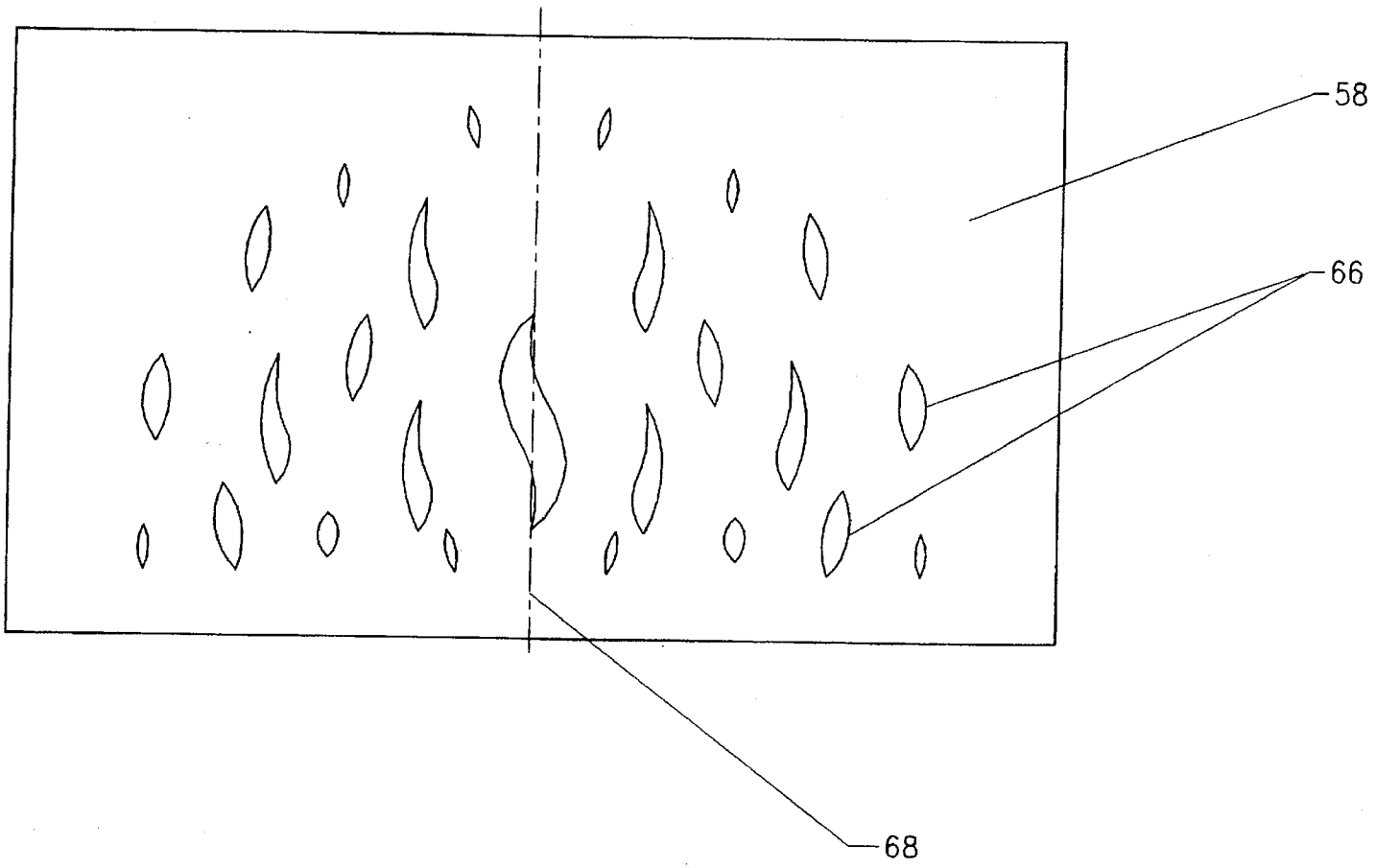
FIG. 5 is a front view of a flame effect element for the assembly of FIG. 1.

As shown in FIG. 5, the flame effect element 58 is formed from a single thin sheet of a light-weight, substantially opaque, material such as polyester. The element 58 extends across substantially the full width of the screen 42. A plurality of slits 66 are cut into the flame effect element 58 to permit passage of light through the flame effect element 58 as it billows under the influence of air currents from the blower 60. Longer sized slits 66 are located at the lower end of the flame effect element 58 to simulate longer flames emanating from the fuel bed 26. Smaller slits 66 are located at the upper end of the flame effect element 58 to simulate the licks of flames that appear above the large main flames emanating from the fuel bed 26. The slits 66 are arranged in a pattern that is symmetrical about a center axis 68 of the flame effect element 58 to give a balanced appearance to the flame effect. The element 58 may be coated with a plastic film (such as polyurethane) to retard fraying about the edges of the slits. Alternatively, the flame effect element could comprise a plurality of discrete flame effect elements 58 as disclosed in U.S. Pat. No. 4,965,707 that is incorporated herein by reference.

The flame effect element 58 is supported at its bottom end by fasteners 70 that connect to the lower horizontal support member 50. The flame effect element 58 is supported at its upper end by fasteners 72 that connect to an upper horizontal support member 74. The upper horizontal support member is connected by fasteners 76 to the side walls of the housing 14.

The flame effect element 58 is supported relatively loosely between the horizontal supports so that it will billow or ripple with the air currents from the blower 60. The blower 60 is supported by a mounting bracket 78 that is supported with fasteners 80 to the bottom wall of the housing 14. An airflow control switch 83 is provided on the control unit 21 to vary the blower airflow to a desired amount. The greater the airflow, the more active the flame will appear. Alternatively, the flame effect element 58 may be moved mechanically to produce sufficient billowing or rippling to give the flame effect.

In use, light is transmitted from the light source 30 through the slits 66 of the flame effect element 58 to the diffusing surface 46 of the screen 42. The flame effect element 58 billows in the airflow from the blower 60 to vary the position and size of the slits 66. The resulting effect is for the transmitted light to resemble flames licking from a fire. As will be explained further below, the transmitted light is at least partially colored due to its reflecting from a colored reflecting surface 82 of a flicker element 62, 64 prior to passing through the slits 66.

Figure 6:
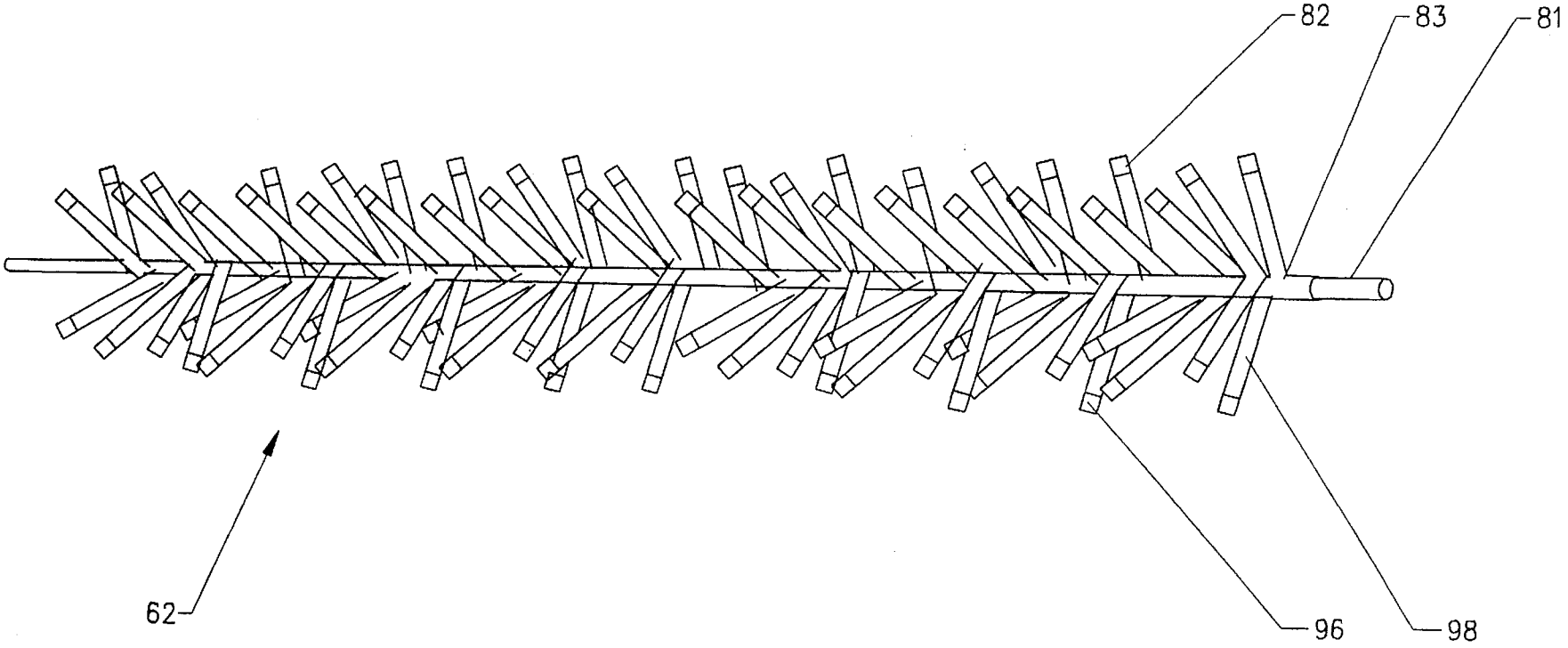
FIG. 6 is a perspective view of the upper flicker element for the assembly of FIG. 1, as viewed along direction arrow 6 in FIG. 3.
Figure 8:
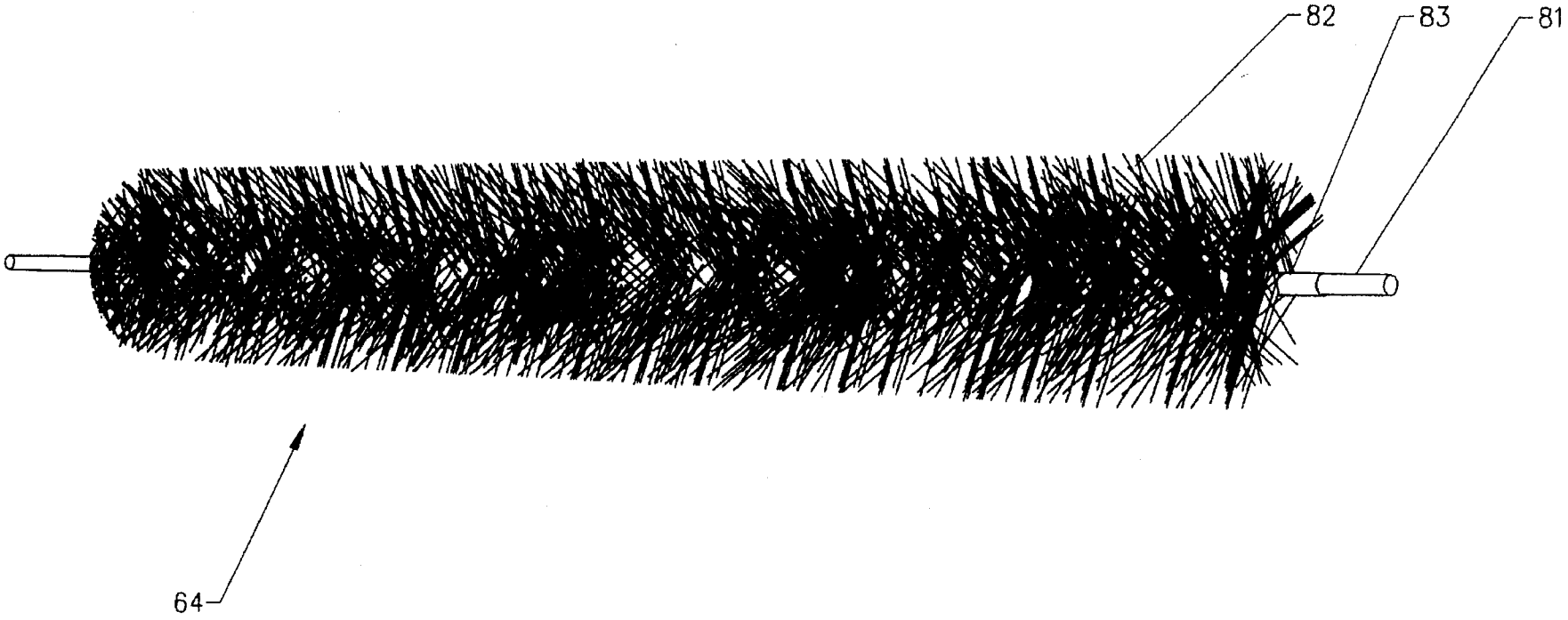
FIG. 8 is a perspective view of the lower flicker element for the assembly of FIG. 1, as viewed along direction arrow 8 in FIG. 3.

The upper and lower flicker elements 62, 64 are located rearwardly from the flame effect element 58 proximate to the rear wall of the housing 14. As shown in FIGS. 6 and 8, each flicker element comprises an elongate rod 81 having a plurality of reflective strips 82 extending radially outwardly therefrom. The flicker elements 62, 64 preferably have a diameter of about two to three inches. The strips 82 are formed from a length of material having a width of approximately one and a half inches. A series of transverse slits are cut along one elongate side of the length of the material 83 to define each individual strip 82. The length of material 83 is then wrapped about the rod 81 so that the strips 82 protrude radially about the full circumference of the rod 81. Alternatively, the strips 82 may be cut to lengths of around two to three inches and clamped at their centers by spiral wound wires that form the rod 81. Alternatively, the reflective surfaces of the flicker elements could be mirrored glass pieces arranged about the surface of a cylinder.

The rods 81 are supported at one end in corresponding recesses 84 defined in a vertical support arm 86 that is connected by fasteners 88 to the bottom wall of the housing 14. The rods 81 are connected at their other end to corresponding rotors 90 for rotating each rod 81 about its axis. The rotors 90 are rotated by electric motors 91 as shown. The rotors 90 are supported by a vertical support member 92 that is connected with fasteners 94 to the bottom wall of the housing 14. Alternatively, the rotor 90 may be rotated by air currents from the blower 60 engaging corresponding fins on the rotors. Preferably, the rotors 90 rotate the flicker elements 62, 64 in the direction indicated by arrow 93 in FIG. 2 so that an appearance of upward motion is imparted on the reflected light images. This simulates the appearance of upwardly moving gasses from a fire. It is contemplated that other means for simulating the appearance of upwardly moving gasses may be used. For instance, a light source (not shown) may be contained within a moving, partially opaque, screen (not shown) to produce the desired light effect. It is also contemplated that the flicker elements 62, 64 or the above described gas simulating means may be used alone without the flame effect element 58. It has been found that the use of the flicker elements 62, 64 alone produces a realistic effect although not as realistic as when used in combination with the flame effect element 58.

Figure 2:
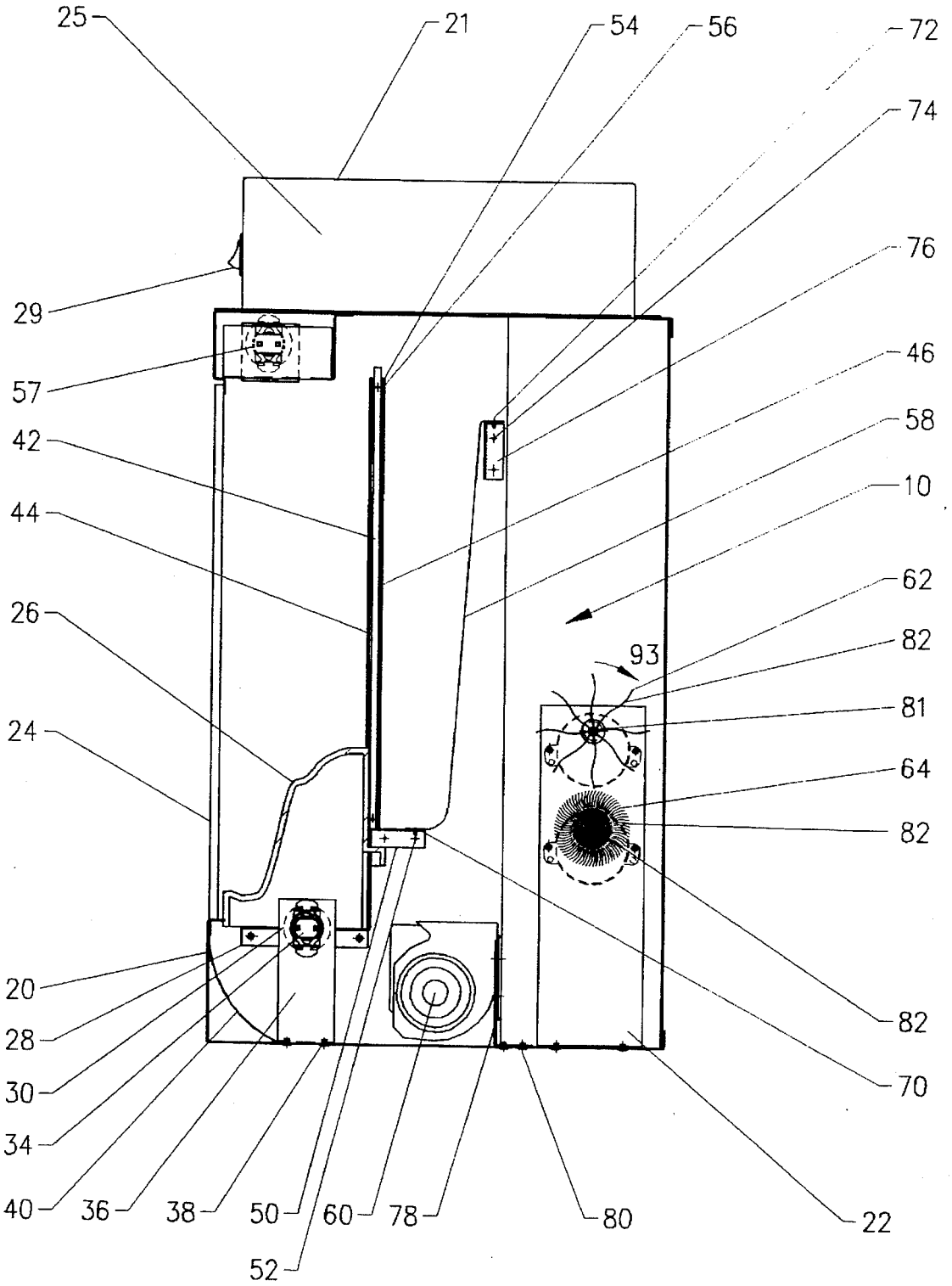
FIG. 2 is a side view of the assembly of FIG. 1 showing elements behind the side wall.
Figure 3:
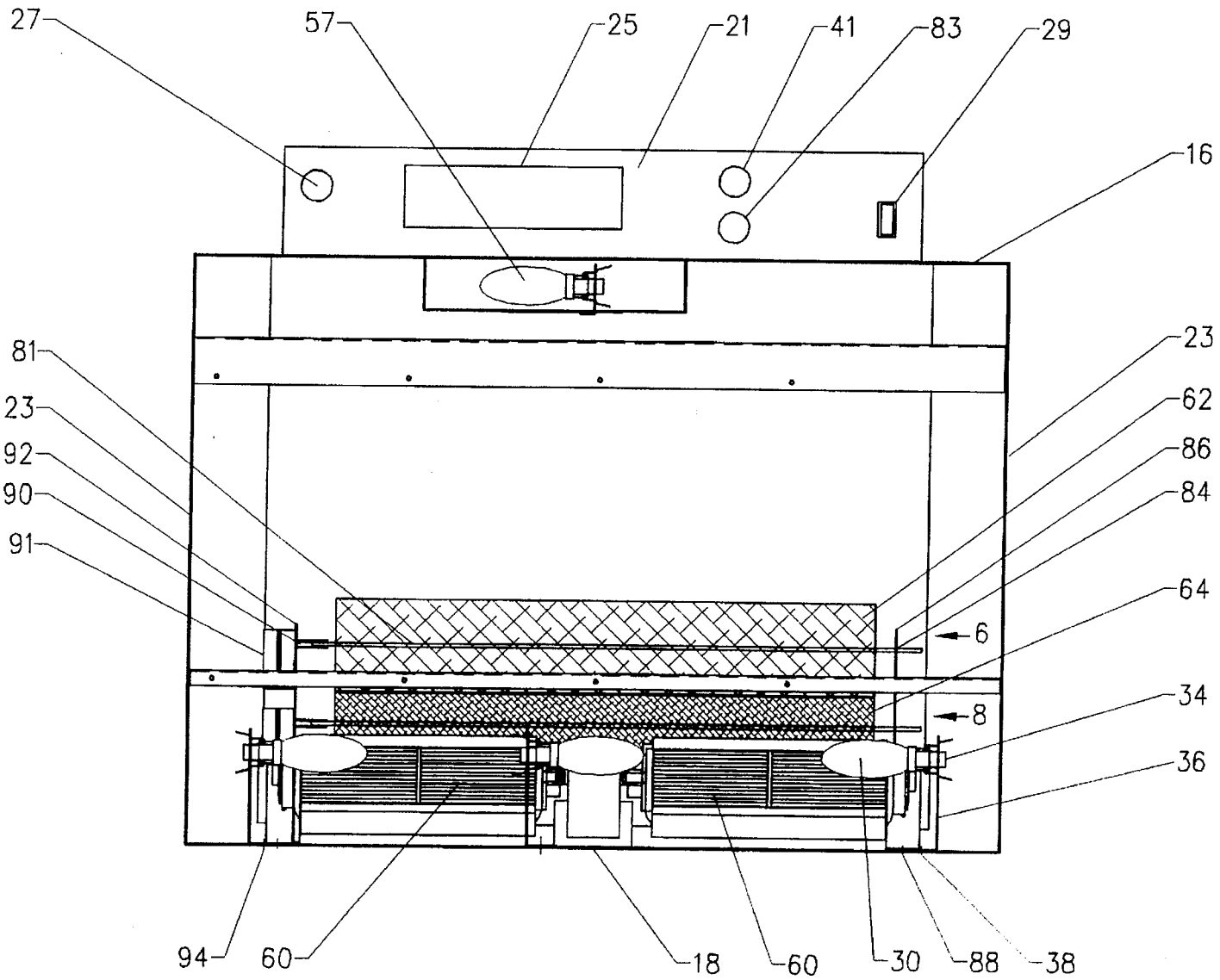
FIG. 3 is a front view of the assembly of FIG. 1 showing elements below the top wall.
Figure 4:
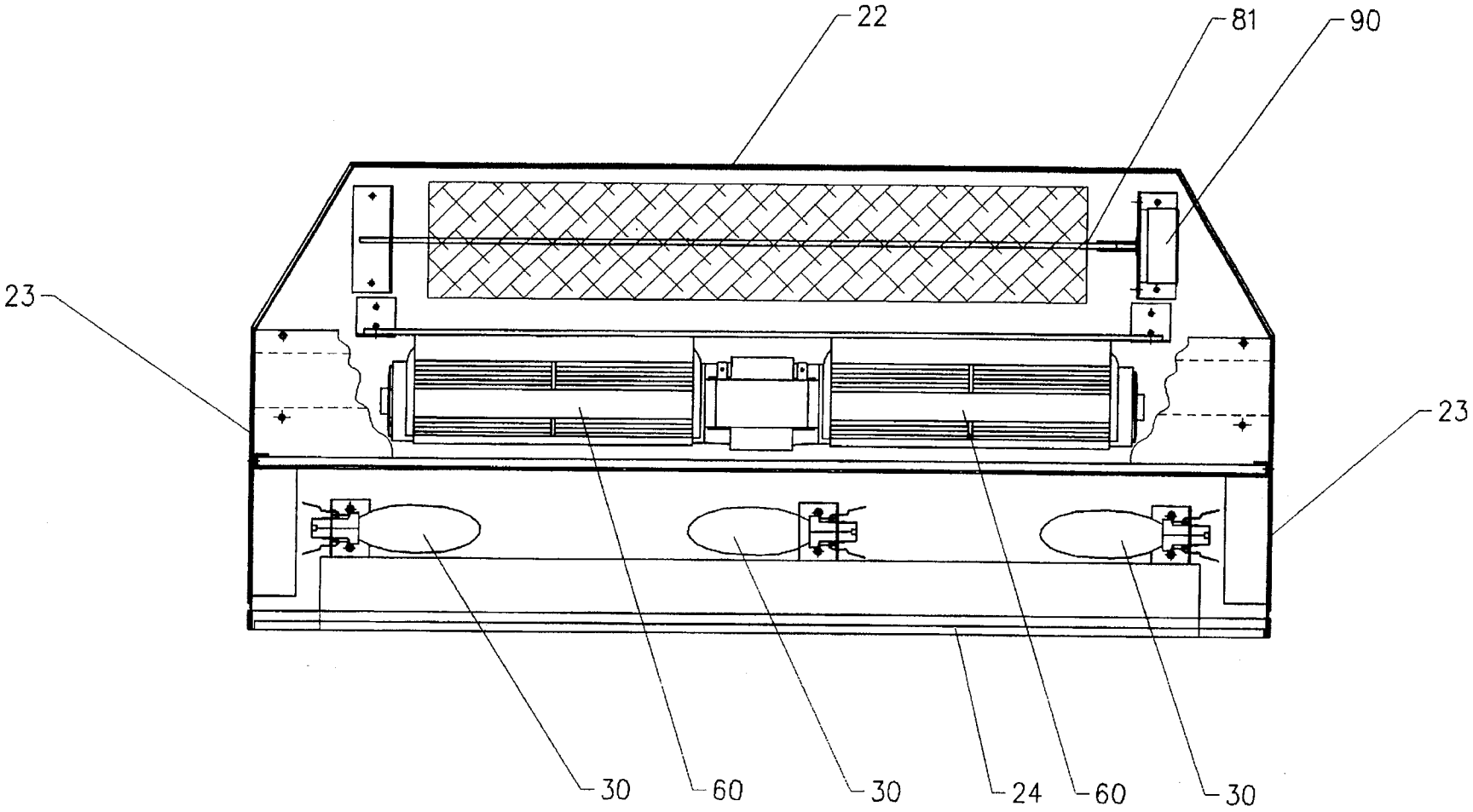
FIG. 4 is a top view of the assembly of FIG. 1 showing elements behind the front wall.

Referring to FIG. 2, it may be seen that the lower flicker element is positioned slightly below the horizontal level of the upper end of the fuel bed 26. This facilitates the appearance of upwardly moving gasses and colored flames emanating from near the surface of the fuel bed when viewed by a person in front of the fireplace. Similarly, the upper flicker element is positioned at a horizontal level above the fuel bed 26 to give the appearance of upwardly moving gasses and colored flames emanating a distance above the fuel bed when viewed by a person in front of the fireplace. In addition, the upper and lower flicker elements 62, 64 improve the light intensity of the simulated flame and gasses.

Figure 7:
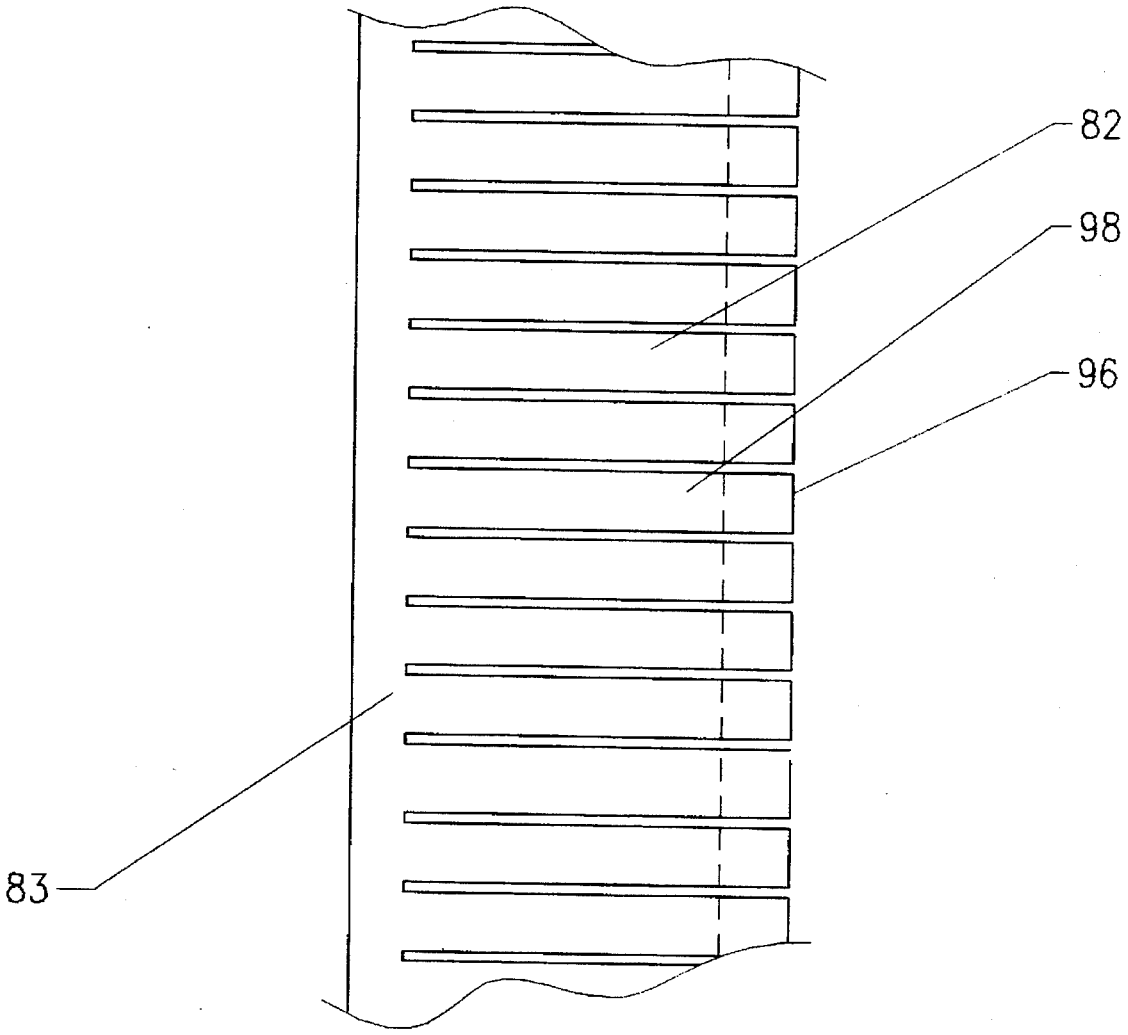
FIG. 7 is a partial plan view of a length of material defining a plurality of radial strips for the upper flicker element of FIG. 1.

Referring more closely to FIG. 7, the strips 82 for the upper flicker element 62 are shown. Each strip 82 is formed from a reflective material such as MYLAR™. The strip 82 is preferably colored with either a blue or red tip 96 and a silver body 98, although a fully silver body has been used successfully as well. A length of material 83 with red tipped strips 82 and a length of material 83 with blue tipped strips 82 may both be wrapped about the rod 81. As shown in FIG. 6, a combination of blue and red tipped strips 82 protrude radially from the rod 81 over the entire length of the flicker element 62. As a result, the upper flicker element 62 reflects white, red and blue light that is subsequently transmitted through the flame effect element 58.

The lower flicker element 64, as shown in FIG. 8, comprises a dense arrangement of thin strips 82 that are formed from a reflective material such as MYLAR™. The strips 82 are either substantially gold in color, or substantially red in color. A combination of lengths of material 83 with red strips 82 and gold strips 82 may be wrapped around the rod 81 to produce an overall red and gold tinsel appearance. As a result, the lower flicker element 64 reflects yellow and red light that is subsequently transmitted through the flame effect element 58.

In use, the flicker elements 62, 64 are rotated by the rotors 90 so that the reflective surfaces of the strips 82 reflect colors through the slits 66 of the billowing flame effect element 58 and produce the effect of upwardly moving gasses. The colors reflected by the lower flicker element 64 resemble the colors of flames located near the surface of the fuel bed 26. The colors reflected by the upper flicker element 62 resemble the colors of flames that are located further from the surface of the fuel bed 26. The upper flicker element 62 has a less dense arrangement of strips 82 in order to produce more random reflections that simulate a more active flickering flame at a distance above the fuel bed 26. The more dense arrangement of strips 82 in the lower flicker 64 produces relatively more constant reflections that simulate the more constant flame activity adjacent to the fuel bed 26.

It is to be understood that what has been described is a preferred embodiment to the invention. The invention nonetheless is susceptible to certain changes and alternative embodiments fully comprehended by the spirit of the invention as described above, and the scope of the claims set out below.

We claim:

1. A flame simulating assembly comprising:

a light source;

a flame effect element having means for transmitting light from said light source to produce a moving flame effect;

at least one flicker element having at least one reflective surface, said flicker element being positioned intermediate of said light source and said flame effect element to reflect light from said light source for subsequent transmission by said flame effect element;

a screen having a partially reflecting surface and a diffusing surface, said flame effect element extending proximate to said diffusing surface wherein said transmitted light produces an image on the screen which resembles moving flames; and a simulated fuel bed positioned adjacent to said partially reflecting surface wherein an image of the fuel bed is displayed on the screen and wherein the image of moving flames appears to emanate between the simulated fuel bed and its image in the screen.

2. An assembly as claimed in claim 1, further comprising means for moving said flame effect element to produce said moving flame effect.

3. An assembly as claimed in claim 2, wherein said moving means comprises an airflow generator.

4. An assembly as claimed in claim 3, wherein said flame effect element is adapted to move in response to an airflow.

5. An assembly as claimed in claim 1, wherein said light source is located beneath said simulated fuel bed.

6. An assembly as claimed in claim 1, further comprising a parabolic mirror for reflecting light from said light source toward said flicker element and said flame effect element.

7. An assembly as claimed in claim 1, wherein said flicker element reflective surface is substantially silver in color.

8. An assembly as claimed in claim 1, wherein said flicker element reflective surface is at least partially red in color.

9. An assembly as claimed in claim 1, wherein said flicker element reflective surface is at least partially blue in color.

10. An assembly as claimed in claim 1, comprising a plurality of said flicker elements, wherein an upper flicker element and a lower flicker element are positioned rearwardly of said flame effect element.

11. An assembly as claimed in claim 10, wherein said reflective surface of said lower flicker element is at least partially red in color.

12. An assembly as claimed in claim 11, wherein said reflective surface of said upper flicker element is substantially silver in color.

13. An assembly as claimed in claim 1, further comprising a rotor for rotating said flicker element about an axis.

14. An assembly as claimed in claim 13, wherein said flicker element is rotated in a direction to simulate upwardly moving gasses from a fire.

15. An assembly as claimed in claim 13, wherein said rotor is rotated by an electric motor.

16. An assembly as claimed in claim 13, wherein said axis is arranged generally parallel to the simulated fuel bed.

17. An assembly as claimed in claim 10, wherein said upper and lower flicker elements are rotated about axes that are generally parallel to the simulated fuel bed.

18. An assembly as claimed in claim 10, wherein said upper flicker element is positioned in a horizontal plane above the simulated fuel bed.

19. An assembly as claimed in claim 10, wherein said lower flicker element is positioned in a horizontal plane that is generally below the top of the simulated fuel bed.

20. An assembly as claimed in claim 2, wherein said flame effect element is a single sheet of material that extends substantially across the width of the screen, said sheet having a plurality of slits defined therethrough to facilitate passage of light during movement of said element.

21. An assembly as claimed in claim 2, wherein said flame effect element comprises a plurality of elements that move in response to said moving means.

22. An assembly as claimed in claim 21, wherein said elements have reflective surfaces.

23. An assembly as claimed in claim 22, wherein each of said elements is twisted.

24. An assembly as claimed in claim 1, wherein said fuel bed comprises a vacuum formed plastic shell that is colored to realistically resemble combusting fuel.

25. An assembly as claimed in claim 24, wherein said fuel bed has translucent portions for permitting passage of light from said light source to produce an appearance of glowing embers.

26. A flame simulating assembly comprising:

a light source;

a flame effect element formed of a single sheet of a substantially opaque material having means for transmitting light from said light source to produce a flame effect, said flame effect element being adapted to move in response to an airflow;

an airflow generator;

a screen having a partially reflecting surface and a diffusing surface, said flame effect element extending proximate to said diffusing surface wherein said transmitted light produces an image on the screen which resembles moving flames; and a simulated fuel bed positioned adjacent to said partially reflecting surface wherein an image of the fuel bed is displayed on the screen and wherein the image of moving flames appears to emanate between the simulated fuel bed and its image in the screen.

27. An assembly as claimed in claim 26, wherein said opening comprise a plurality of slits defined through said sheet.

28. An assembly as claimed in claim 26, wherein said opaque material is resistant to fraying.

29. An assembly as claimed in claim 26, wherein said opaque material is covered with a plastic film to resist fraying of the material.

30. A flame simulating assembly, comprising:

a light source;

at least one flicker element having at least one reflective surface for reflecting light from said light source said flicker element being arranged along a generally horizontal axis parallel to said screen;

a rotor for rotating said flicker element about said axis;

a screen having a partially reflecting surface and a diffusing surface, wherein light reflected from said rotating flicker element onto said diffusing surface produces an image which resembles moving gasses from a fire; and a simulated fuel bed positioned adjacent to said partially reflecting surface wherein an image of the fuel bed is displayed on the screen and wherein the image of moving gasses appears to emanate between the simulated fuel bed and its image on the screen.

31. An assembly as claimed in claim 30, wherein said flicker element comprises a plurality of reflective strips protruding radially from a rod.

32. An assembly as claimed in claim 31, wherein said strips are substantially silver in color.

33. An assembly as claimed in claim 31, wherein said strips have red or blue colored tips for coloring the reflected light.

34. An assembly as claimed in claim 31, wherein at least some of said strips are substantially gold in color.

35. An assembly as claimed in claim 31, wherein at least some of said strips are at least red in color.

36. An assembly as claimed in claim 31, wherein at least two of said flicker elements are provided.

37. An assembly as claimed in claim 1, further comprising a fuel bed light assembly located beneath said fuel bed, said light assembly including a plurality of lights that flicker at different times.

* * * * *